US008820722B2

(12) United States Patent
Reinert, Sr.

(10) Patent No.: US 8,820,722 B2
(45) Date of Patent: Sep. 2, 2014

(54) BARRIER FENCING SYSTEM

(76) Inventor: Gary L. Reinert, Sr., Las Vegas, NV (US)

( * ) Notice: Subject to any disclaimer, the term of this patent is extended or adjusted under 35 U.S.C. 154(b) by 0 days.

(21) Appl. No.: 13/079,371

(22) Filed: Apr. 4, 2011

(65) Prior Publication Data

US 2012/0049143 A1 Mar. 1, 2012

Related U.S. Application Data

(62) Division of application No. 12/054,012, filed on Mar. 24, 2008, now abandoned.

(60) Provisional application No. 60/919,641, filed on Mar. 23, 2007.

(51) Int. Cl.
*E04H 17/22* (2006.01)

(52) U.S. Cl.
USPC ..... 256/65.14

(58) Field of Classification Search
USPC ..... 256/19, 21, 24, 32, 65.14
See application file for complete search history.

(56) References Cited

U.S. PATENT DOCUMENTS

| | | | | | |
|---|---|---|---|---|---|
| 189,323 | A * | 4/1877 | Root | 256/21 |
| 221,449 | A * | 11/1879 | Wolfe | 52/165 |
| 1,211,059 | A * | 1/1917 | Blank | 256/1 |
| 1,214,679 | A * | 2/1917 | Hindmarsh | 52/153 |
| 1,270,112 | A * | 6/1918 | Brown | 256/1 |
| 4,279,104 | A * | 7/1981 | Classen | 52/38 |
| 5,180,143 | A * | 1/1993 | Brower | 256/24 |
| 5,709,366 | A * | 1/1998 | Speece | 248/530 |
| 5,755,431 | A * | 5/1998 | Williams | 256/65.14 |
| 5,857,664 | A * | 1/1999 | Schauman | 256/19 |
| 6,866,251 | B2 * | 3/2005 | Rosaen | 256/65.14 |
| 7,500,654 | B2 * | 3/2009 | Rosaen | 256/65.14 |
| 7,503,550 | B2 * | 3/2009 | Liefke | 256/65.14 |

FOREIGN PATENT DOCUMENTS

| | | | | |
|---|---|---|---|---|
| EP | 0 222 954 | * | 5/1987 | E04H 17/06 |
| FR | 2 571 771 | * | 4/1986 | E04H 17/20 |

* cited by examiner

*Primary Examiner* — Michael P Ferguson
(74) *Attorney, Agent, or Firm* — Ronald Law Group, LLC

(57) ABSTRACT

A barrier fencing arrangement, including a foundation member positioned at least partially below a ground surface, wherein the foundation member includes a body with a top portion and at least one fin extending from the body. An extension member, having a body attached to or integral with the body of the foundation member, extends from the top portion of the body of the foundation member at least partially above the ground surface.

14 Claims, 13 Drawing Sheets

BARRIER FENCING SYSTEM

CROSS REFERENCE TO RELATED APPLICATIONS

This application is a divisional of U.S. patent application Ser. No. 12/054,012, filed Mar. 24, 2008, which claims the benefit of U.S. Provisional Application No. 60/919,641, filed Mar. 23, 2007, both of which are hereby incorporated by reference in their entireties.

BACKGROUND OF THE INVENTION

1. Field of the Invention

The present invention relates general to fencing systems and similar barrier-type arrangements, and in particular, to a modular fencing system that can be used in connection with preexisting and new anchoring and foundation support systems and arrangements.

2. Description of the Related Art

In the field of security, e.g., border security, various devices and systems must be employed to successfully establish a safe and protected border between various countries and other entities. In order to establish this border and according to the prior art, various fencing and other barrier systems are employed in an attempt to prevent unauthorized vehicles and persons from penetrating the border. Such border security has become a top priority of the United States, as discussed in detail in the publication *Border Security: Barriers Along the U.S. International Border*, CRS Report for Congress, updated Dec. 12, 2006. In particular, this publication indicates that "[c]ongress has been considering expanding the barriers currently deployed along the U.S. international land border." Further, "the United States Border Patrol (USBP) deploys fencing, which aims to impede the illegal entry of individuals, and vehicles . . . along the border."

According to the prior art and in connection with border security, current fence barrier systems being utilized involve a significant amount of components that require considerable time to put together during the installation process. First, primary vehicle barriers (sometimes referred to as bollards) have been installed to prevent or inhibit vehicles from penetrating the border area. Separate primary and secondary fencing has been erected, where appropriate, behind or near these primary vehicle barriers, which provides protection against unauthorized persons from compromising the border. In addition, there are multiple steps involved to complete the installation process, and in many instances, such existing systems are unable to meet all of the United States Customs and Border Patrol performance criteria for the specified "Fence Barrier System". Further, current arrangements and methods being used are both costly and timely when trying to meet the required performance criteria given the location, terrain, and accessibility to the border in which the Fence Barrier System is needed.

One prior art method and system for providing a structural and foundational base for use in connection with other arrangements and systems is taught and claimed in U.S. Pat. No. 4,882,891, which is incorporated herein by reference, and which discloses an apparatus and method for installing a structural anchor and/or foundation in an earthen hole. In particular, this foundation includes radially-extending vanes or fins extending from a longitudinal component for resisting overturning moments and forces, which provides for a stronger foundation. Similar arrangements and foundation installation methods and associated equipment are taught and claimed in U.S. Pat. Nos. 4,843,785; 4,974,997; 5,570,975; 5,660,504; 5,733,068; and 5,944,452, all of which are also incorporated herein by reference.

As discussed above, it has become a primary concern to provide heightened security, e.g., protection against foot traffic, in many unguarded areas, or areas that include only primary vehicle barriers. While erection of separate fencing and/or vehicle barriers is available, there is a need for a barrier fencing system that is easy to install in a modular approach. Further, there remains a need for improved barrier fencing systems and arrangements that are effective and tamper resistant or tamper proof. There is considerable room for improvement in the important area of border control and security.

SUMMARY OF THE INVENTION

It is, therefore, one object of the present invention to provide a barrier fencing arrangement that overcomes some or all of the drawbacks and deficiencies of the prior art. It is another object of the present invention to provide a barrier fencing arrangement that is relatively simple in its installation and provides appropriate security against unauthorized persons from tunneling under and/or vehicles from driving through the border. It is a further object of the present invention to provide a barrier fencing arrangement that can be installed in a modular approach. It is a still further object of the present invention to provide a barrier fencing arrangement that can be installed with or integrated with existing structures and systems, e.g., foundational systems, anchoring devices, existing barriers, permanent vehicle barriers, etc. It is yet another object of the present invention to provide a barrier fencing arrangement that allows for effective installation regardless of location, terrain, and accessibility. It is another object of the present invention to provide a barrier fencing arrangement that can meet some or all of the required performance criteria and provide for a cost effective and expedient installation method and process for securing borders and border areas, where appropriate.

According to one aspect of the present invention, provided is a barrier fencing arrangement. This arrangement includes a foundation member positioned at least partially below a ground surface, and the foundation member has a body with a top portion and at least one fin extending from the body. An extension member, having a body attached to or integral with the body of the foundation member, extends from the top portion of the body of the foundation member at least partially above the ground surface.

According to another aspect of the present invention, provided is a barrier fencing arrangement that includes a foundation member positioned at least partially below a ground surface, where the foundation member has a body with a top portion and at least one fin extending from the body. The arrangement further includes a fence arrangement for direct or indirect attachment to the foundation member.

According to a still further aspect of the present invention, provided is a barrier fencing arrangement having a foundation member positioned at least partially below the ground surface. The foundation member includes a body with a top portion and at least one fin extending from the body. An extension member, having a body attached to or integral with the body of the foundation member, extends from the top portion of the body of the foundation member at least partially above the ground surface. A fence arrangement is attached or attachable to at least one of the foundation member and the extension member.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
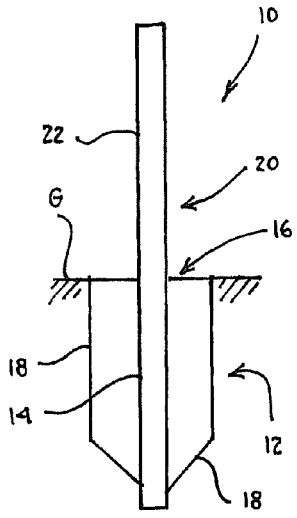
FIG. 1 is a front view of one embodiment of a barrier fencing arrangement according to the principles of the present invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

It is to be understood that the invention may assume various alternative variations and step sequences, except where expressly specified to the contrary. It is also to be understood that the specific devices and processes illustrated in the attached drawings, and described in the following specification, are simply exemplary embodiments of the invention.

The present invention is directed to a barrier fencing arrangement 10, which is illustrated in various embodiments and views in FIGS. 1-19. It should be noted that the barrier fencing arrangement 10 of the present invention can be used in connection with a variety of security and control projects and applications. For example, some or all of the embodiments, whether alone or in combination, of the barrier fencing arrangement 10 can be used in border control applications that require specified levels of security and prevention features. Accordingly, some of the embodiments of the barrier fencing arrangement 10 of the present invention (whether alone, combined together, or positioned adjacently) can be used as primary vehicle barriers, primary fencing units and systems, secondary fencing units and systems, and as other security arrangements that are used and required at border areas. However and as discussed, the present invention is not exclusive to border control applications, and can be used in a variety of situations that require appropriate and secure areas, where the level of security is adjustable based upon the nature, amount and combination of embodiments used of this barrier fencing arrangement 10. Accordingly, the present invention is effective in providing security and control features at border areas, but also such functionality and features to other areas and applications that require heightened and effective security and similar measures.

Still further, the barrier fencing arrangement 10 of the present invention, as discussed hereinafter, may include a variety of components and structural pieces and parts. These components and parts may be manufactured, fabricated and/or formed from a variety of different and known materials. For example, some or all of the components and parts of the barrier fencing arrangement 10 can be manufactured or fabricated from metallic materials, synthetic materials, organic materials, steel, carbon steel, stainless steel, aluminum, wood, alloys, combinations and mixtures of such materials, etc. While in some preferred and non-limiting embodiments of the present invention, the components and parts of the barrier fencing arrangement 10 are manufactured or fabricated from steel or similar metallic materials, any materials of construction can be used to accomplish the novel functionality, security and control features provided by this barrier fencing arrangement 10.

One preferred and non-limiting embodiment of the barrier fencing arrangement 10 of the present invention is illustrated in FIG. 1. In this embodiment, the arrangement 10 includes a foundation member 12 that is positioned at least partially below a ground surface G. The foundation member 12 includes a body 14 with a top portion 16. In addition, at least one fin 18 extends from the body 14. While any number of fins 18 may be used, in one preferred and non-limiting embodiment, two fins 18 are used and extend radially from the body 14. These fins 18 serve to resist an overturning moment or force, as they are positioned under the ground surface G, i.e., buried underground. Normally and due to the lateral and extending planar nature of the barrier fencing arrangement 10, only two such fins 18 are required in order to resist movement, moments, or impact at the face or rearward portions, as opposed to on the sides. Of course, additional fins 18 may be added to resist other impact directions, forces and moments that are angular or from a sideward or obtuse angle.

The fins 18 may take a variety of forms and have various, different dimensions. For example, these fins 18 may be square-shaped, rectangle-shaped, triangle-shaped, polygon-shaped, etc. Similarly, the material of construction, thickness and other dimensions can be varied according to the amount of resistance to overturning is required. In addition, the shape can be varied to affect the ease of installation, i.e., positioning the foundation member 12 at least partially into an area below the ground surface G. Still further, the fins 18 may be manufactured or fabricated integrally with the body 14 of the foundation member 12, or manufactured separately and, thereafter, attached via a number of known attachment methods, e.g., welding or the like.

As also illustrated in FIG. 1, this embodiment of the barrier fencing arrangement 10 includes an extension member 20, also having a body 22, that is directly or indirectly attached to or integral with the body 14 of the foundation member 12. Further, this extension member 20 extends from the top portion 16 of the body 14 of the foundation member 12, and at least partially above the ground surface G. In this manner, the extension member 20 acts as a longitudinal extension of the foundation member 12 that projects above the ground surface G. As seen in the various embodiments of the barrier fencing arrangement 10 of the present invention, the foundation member 12 and extension member 20 may also take a variety of geometric forms, and in one preferred and non-limiting embodiment, are tubular. Similarly, the foundation member 12 and extension member 20 can be made from materials appropriate to achieve the intended purpose.

In the preferred and non-limiting embodiment of FIG. 1, the foundation member 12 and the extension member 20 are integral and manufactured from a single tubular length of material, e.g., steel or the like. The illustrated structure may be used in different applications, for example, this embodiment of the barrier fencing arrangement 10, when used in connection with further, adjacent barrier fencing arrangements 10, create a wall or barricade useful as a primary vehicle barrier in a security area, as well as for preventing tunneling underground (due to the positioning of the fins 18 of adjacent foundation members 12). However, any number of such uses are envisioned.

Figure 2:
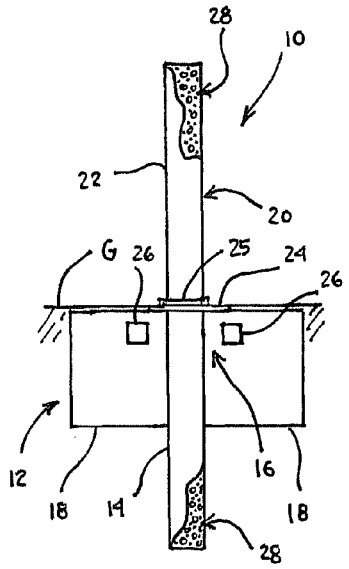
FIG. 2 is a front view of another embodiment of a barrier fencing arrangement according to the principles of the present invention.

A further preferred and non-limiting embodiment of the barrier fencing arrangement 10 of the present invention is illustrated in FIG. 2. In this embodiment, a bearing plate 24 is attached to the top portion 16 of the foundation member 12, and the extension member 20 is attached to this bearing plate 24. Of course, the bearing plate may be attached to a bottom portion of the extension member 20, and subsequently attached to the top portion 16 of the foundation member 12. In either case, this would allow any number and type of extension member 20 to be attached to a pre-existing foundation member 12 already installed below the ground surface G. Any securing arrangement for attaching the foundation member 12, extension member 20, and bearing plate 24 is envisioned, e.g., bolting, welding, etc. For example, the bearing plate 24 may include bolt holes or the like and the extension member 20 attached through a bearing plate 25 attached to or integral with the extension member 20. As is known in the art, bolts/nuts may be fastened through aligned bolt holes on the bearing plates 24, 25 to attach the foundation member 12 to the extension member 20. Again, such an arrangement would allow for the retrofitting of any number of components of the barrier fencing arrangement 10 to an existing or installed foundation member 12.

As also illustrated in FIG. 2, in order to manipulate the foundation member 12, whether or not integral with or attached to the extension member 20, one or more lift holes 26 can be positioned on the fins 18. Such lift holes 26 are sized and shaped so as to accept the forks of a forklift truck, which allows the forklift truck to pick up and appropriately position the foundation member 12 for positioning, installation and/or removal.

As also illustrated in FIG. 2, and in order to add an additional level of structural strength to the foundation member 12 and/or the extension member 20, a material 28 can be positioned within the foundation member 12 and/or extension member 20 (or, as discussed hereinafter, other components of the barrier fencing arrangement 10). For example, concrete, rods, aggregate, mortar, stone, wood, etc. may be inserted into an inner or hollow area of the foundation member 12 and/or extension member 20, and this material 28 would provide an additional level of strength and impenetrably to the installed barrier fencing arrangement 10. As with the embodiment of FIG. 1, the barrier fencing arrangement 10 of FIG. 2 may be effectively utilized as a primary vehicle barrier in a border control application.

Figure 3:
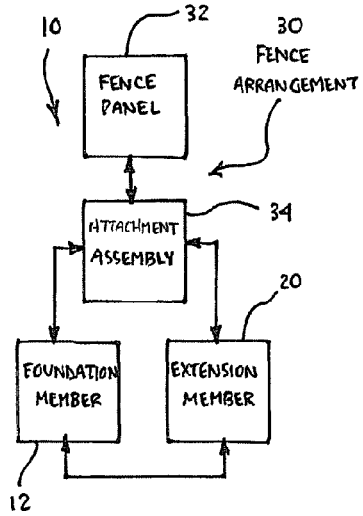
FIG. 3 is a schematic view of a further embodiment of a barrier fencing arrangement according to the principles of the present invention.

In another preferred and non-limiting embodiment, additional barriers are provided, which may be used as primary or secondary fencing. In particular, a fence arrangement 30 is provided for direct or indirect attachment to the foundation member 12 and/or the extension member 20. Accordingly, in this embodiment, this fencing arrangement 30 can be attached to a previously installed or pre-existing foundation member 12, as well as a pre-existing or installed extension member 20 (which is attached to or integral with the foundation member 12). Accordingly and as illustrated in FIG. 3, the fence arrangement 30 includes at least one fence panel 32, which is directly or indirectly attached to the foundation member 12 and/or extension member 20 via an attachment assembly 34. When used with the extension member 20, the joint function of a primary vehicle barrier as well as a primary/secondary fence structure is achieved, and when used only with the foundation member 12, the primary/secondary fence structure and function is provided. Any number, type, or configuration of attachment between the fence arrangement 30, foundation member 12, and/or extension member 20 is envisioned.

The fence panel 32 may be formed from a variety of materials and structural arrangements. For example, the fence panel 32 may be formed from a mesh material, a fencing material, an expanded metal material, metal, a plate material, a plurality of posts, a grated surface, a framed section, etc. In addition, the fence panel 32 may be constructed from a mesh or expanded metal material held in form by a frame around the edges of this material. Of course, the fence panel 32 may also be a solid or plate material with no or minimal holes or orifices extending therethrough.

Figure 4:
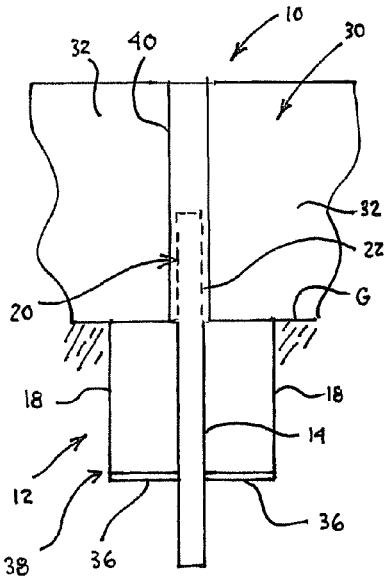
FIG. 4 is a front view of a still further embodiment of a barrier fencing arrangement according to the principles of the present invention.

A further preferred and non-limiting embodiment of the barrier fencing arrangement 10 of the present invention is illustrated in FIG. 4. In this embodiment, the fins 18 include a beveled edge 36 on a bottom portion 38 of each fin 18. This sharpened, "pointed", or beveled edge 36 allows for easier installation of the foundation member 12 in an orientation below the ground surface G. In addition, this embodiment includes the foundation member 12 and extension member 20, which extends above the ground surface G.

The fence arrangement 30 includes an attachment assembly 34 that is at least in the form of at least one sleeve member 40 that is sized and shaped so as to be positioned at least partially over the extension member 20. For example, this sleeve member 40 may be in the form of a tube with a larger diameter than a diameter of the extension member 20, such that it can be lifted, positioned over, and slid over the extension member 20 and either attached to the extension member 20, the foundation member 12 (i.e., the top portion 16, the fins 18, etc.), or simply resting on the ground surface G. Further, one or more fence panels 32 are attached to the sleeve member 40 in a variety of manners, as discussed hereinafter. For example, an edge of adjacent fence panels 32 may be welded directly to the sleeve member 40, or attached through a bracket assembly or similar attaching structure. Similarly, various edges of adjacently-positioned fence panels 32 can be attached to each other at locations where they meet but are not near a sleeve member 40. In any case, the barrier fencing arrangement 10 of this embodiment provides a modular approach to connecting the foundation member 12, extension member 20, and fence arrangement 30, including the fence panels 32 and attachment assembly 34. While welding of the components of the various fencing arrangement 10 is useful in making strong connections, these components can be bolted together or otherwise rigidly attached in an effective manner.

Figure 5:
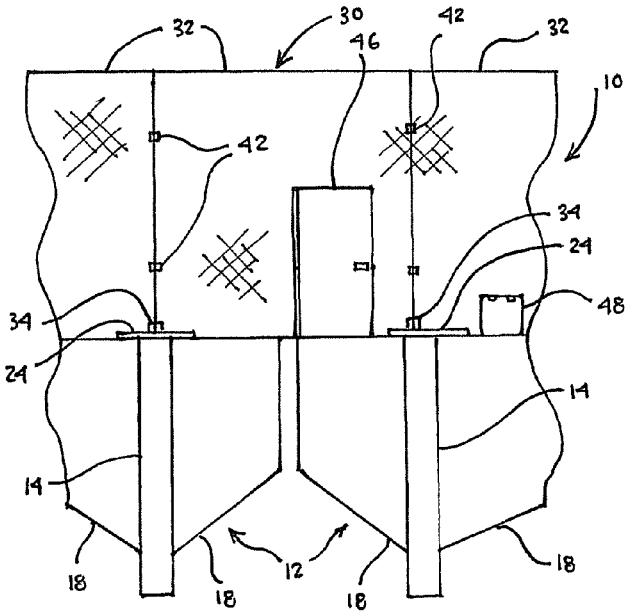
FIG. 5 is a front view of another embodiment of a barrier fencing arrangement according to the principles of the present invention.

A still further preferred and non-limiting embodiment of the barrier fencing arrangement 10 of the present invention is illustrated in FIG. 5. In this embodiment, multiple fence panels 32 are connected together using one or more fence attaching arrangements 42, such as clips, brackets, sleeves, rings, tongue-and-groove arrangements, etc. In addition, the fence panels 32 are attached to the foundation member 12 using the attachment assembly 34 in connection with the bearing plate 24. In particular, and in this embodiment, the attachment assembly 34 may include a further bearing plate, bracket, or other structure that allows for rigid connection to the bearing plate 24, or alternatively attached directly to the top portion 16 of the foundation member 12.

As also seen in FIG. 5, the foundation members 12 can be positioned adjacently and in such a manner that side edges 44 of adjacent fins 18 are located near each other. Using such an arrangement would prevent an unauthorized person from digging below the ground surface G and penetrating the secure area. If such "tunneling" is a concern, the fins 18 could be sized and shaped so as to extend as deep below the ground surface G as required, as well as formed in an appropriate shape and orientation to prevent such unauthorized actions.

In many situations, authorized access must be available for persons to cross through the barrier fencing arrangement 10. Therefore, a doorway 46 can be positioned at various portions along the barrier fencing arrangement 10, and such a doorway 46 may be cut and constructed to permit access through one or more of the fence panels 32, preferably at a position not corresponding with an extension member 20. Any type of door arrangement or access portion through the barrier fencing arrangement 10 is envisioned, and such a doorway 46 may include appropriate security measures and locks to prevent unauthorized penetration. Similarly, often the barrier fencing arrangement 10 of the present invention may extend for many miles, thus preventing certain land borne animals from moving between various areas on either side of the barrier fencing arrangement 10. Accordingly, one or more migration ports 48 may be positioned along the barrier fencing arrangement 10, such as at positions at the bottom of the fence panel 32. These ports 48 could be preinstalled in the fence panel 32, or created on site. Further, such ports 48 may be permanent access holes, hinged access portions, movably coverable access portions, etc. so as to allow an animal to pass, but sized, shaped and/or operable to prevent an unauthorized person from penetrating the barrier fencing arrangement 10. This access portion (whether in the form of a door 46 or a port 48) permits movement through the secure area, and may be in the form of an access opening, an access panel, a removable panel, a swinging panel, a hinged panel, or a movable panel, etc.

In a further preferred and non-limiting embodiment as set forth in FIG. 6, the foundation member 12 is positioned in the area below the ground surface G (as discussed above in detail). However, in this embodiment, the fence arrangement 30 includes a post 50 having a bottom portion 52 with a coupling extension 54 extending from this bottom portion 52. This coupling extension 54 may be integral with the bottom portion 52 of the post 50, or a separate component or unit attached thereto. In addition, in this embodiment, the foundation member 12 includes a hollow inner area 56, and the coupling extension 54 is sized and shaped so as to fit within this inner area 56.

Further, one or more fence panels 32 are directly or indirectly attached to the post 50, such as through welding, a bracket assembly, or bolting, etc. In addition, the coupling extension 54 can be sized, shaped, beveled, angled, etc. so as to provide a substantially flush joint between the posts 50 and the body 14 of the foundation member 12. This joint may be further strengthened through welding or other connection methods. In assembly, the post 50 is simply lowered into the foundation member 12, the coupling extension 54 positioned within the inner area 56 of the body 14 of the foundation member 12, and next, one or more fence panels 32 are attached to the post 50. Of course, the fence panel 32 may be preinstalled or previously attached to the post 50 prior to connection with the foundation member 12.

Figure 7:
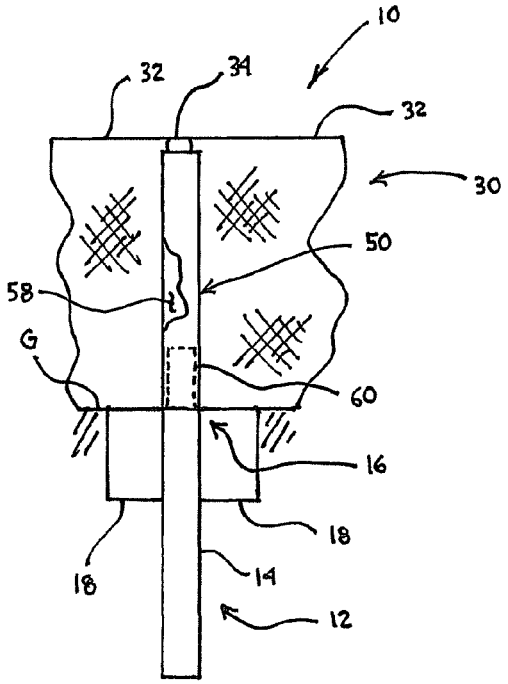
FIG. 7 is a front view of a still further embodiment of a barrier fencing arrangement according to the principles of the present invention.

Yet another embodiment of the present invention is illustrated in FIG. 7, and in this embodiment, it is the post 50 that includes an inner area 58. In addition, a coupling extension 60 extends from the body 14 of the foundation member 12 and is sized and shaped so as to be positioned within the inner area 58 of the post 50. As with the coupling extension 54 of the extension member 20, the coupling extension 60 may be formed integrally with the body 14 of the foundation member 12 or manufactured as a separately attachable component. In addition, in this embodiment, the fence panels 32 are attached to each other and to the post 50 through an attachment assembly 34, such as a bracket assembly or the like. In the assembly process, the post 50 is simply lowered on top of the coupling extension 60 of the foundation member 12, as discussed previously, may be further welded, attached to, or otherwise coupled to the foundation member 12. Next, the fence panels 32 are attached to the post 50 (unless previously attached thereto prior to installation). It is further envisioned that these fence panels 32 can be attached to portions of the foundation member 12, if desired.

Figure 8:
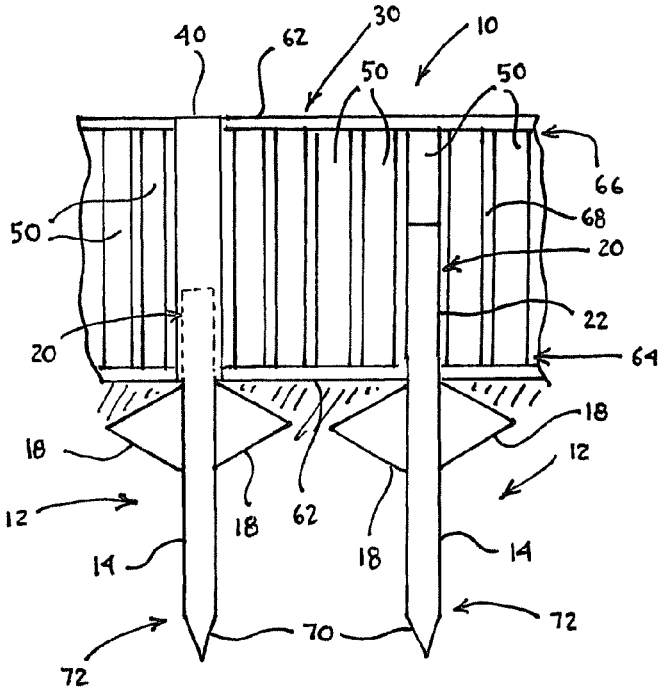
FIG. 8 is a front view of another embodiment of a barrier fencing arrangement according to the principles of the present invention.

A further embodiment of the barrier fencing arrangement 10 of the present invention is illustrated in FIG. 8. In this embodiment, multiple posts 50 are used to create a substantially contiguous fence panel 32. These posts 50 are connected together via a frame bracket 62 that extends along a bottom edge 64 of the post 50, as well as along a top edge 66 of the post 50. Further, and as illustrated in this embodiment, one or more plates 68 are attached to either the frame bracket 62 and/or one or more of the posts 50. Accordingly, a plate 68 may be attached directly to (e.g., via welding) the outer surface of one or more of the posts 50 or the surface of the frame brackets 62. Still further, a portion of either of the frame brackets 62 may be attachable to the foundation member 12, e.g., the fins 18 or body 14, the extension member 20, etc.

In this preferred and non-limiting embodiment, the sleeve member 40 is used and positioned over the extension member 20. The frame brackets 62 and/or the posts 50 can be directly or indirectly attached to this sleeve member 40, which is now positioned over and engaged with the extension member 20. As also illustrated in FIG. 8, various positions along the barrier fencing arrangement 10 of this embodiment may not use a sleeve member 40, and one or more posts 50 may abut the extension member 20, and alternatively, may also be attached or welded thereto.

This embodiment also illustrates a different shape for the fins 18, as well as a different shape for the body 14 of the foundation member 12. In particular, the body 14 includes a pointed edge 70 located at a bottom portion 72 of the body 14 of the foundation member 12. As with the beveled edge 36 of the fins 18, this pointed edge 70 of the foundation member 12 allows for enhanced ease of installation in certain situations and applications, where a hole is not previously prepared, or other installation methods used. Further, the bottom portion 72 of the body 14 may be formed with a bevel, e.g., a 45° angle, a sharpened edge, etc., which would also assist in installation under certain conditions, e.g., hard or rocky ground, clay material, highly compacted soil, etc.

Figure 9:
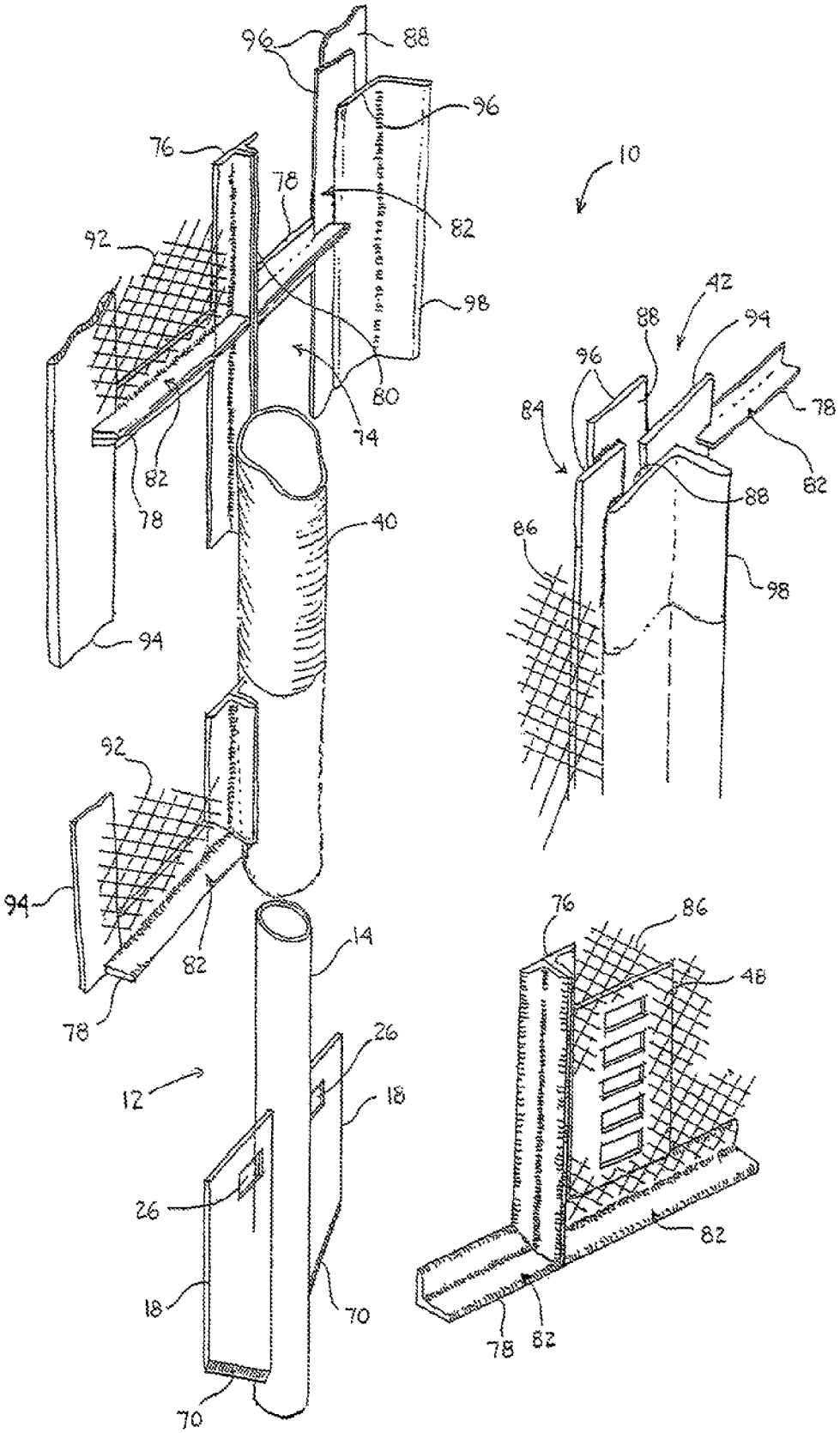
FIG. 9 is a perspective, exploded view of various portions of another embodiment of a barrier fencing arrangement according to the principles of the present invention.
Figure 10:
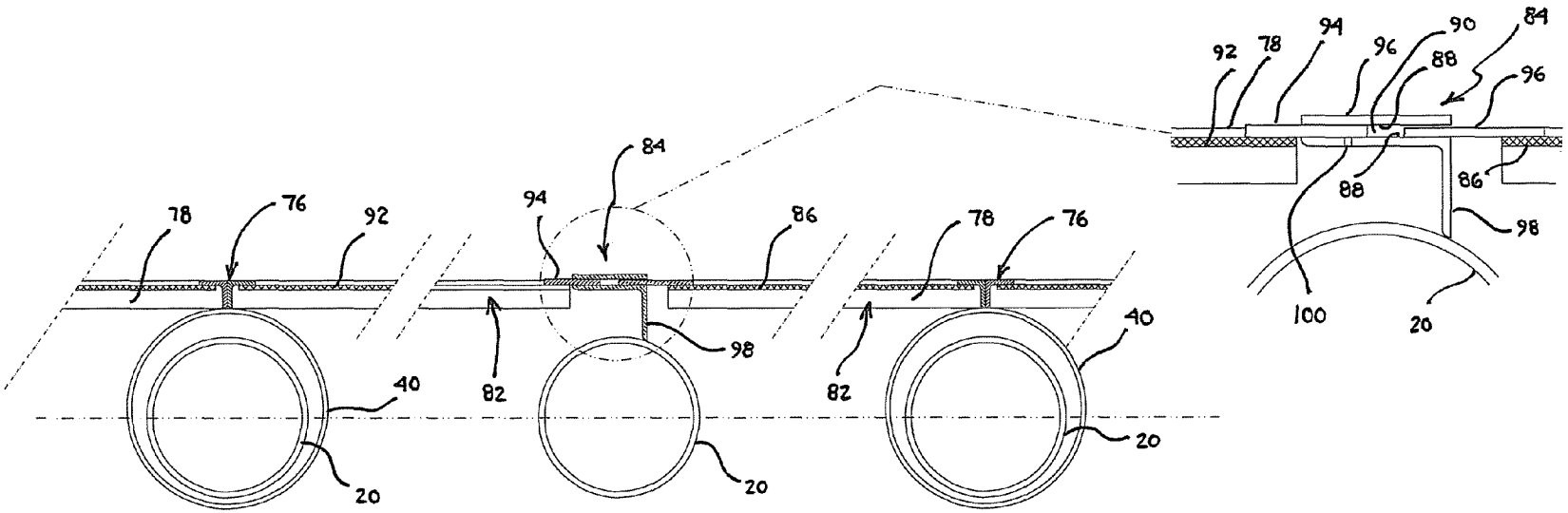
FIG. 10 is a plan view of the embodiment of FIG. 9.

A still further preferred and non-limiting embodiment of the barrier fencing arrangement 10 of the present invention is illustrated in FIGS. 9 and 10. In this embodiment, the above-discussed sleeve member 40 is provided and positioned over an extension member 20, which, in this embodiment, is formed integrally with the body 14 of the foundation member 12. The fence arrangement 30 further includes a bracket assembly 74 directly or indirectly attached to and extending from a surface of the sleeve member 40. A fence panel 32 is attached to or constitutes part of this bracket assembly 74.

In particular, in this embodiment, the fence panel 32 includes the bracket assembly 74, which includes a T-shaped member 76 (which may be formed of two L-shaped brackets 78). A base edge 80 of the T-shaped member 76 is directly attached to (or welded to) an outer surface of the sleeve member 40. In addition, one or more of the L-shaped brackets 78 are attached to or are integral with and extend from specific positions along the T-shaped member 76, preferably extending in both directions. In this manner, the T-shaped member 76 and L-shaped brackets 78 (together with attaching arrangements discussed hereinafter) form a groove 82 into which a mesh material or other fence panel material can be positioned and attached. For example, this portion of the fence panel 32 may be in the form of a mesh material that is tack welded or otherwise attached within the groove 82 at various portions of the T-shaped member 76 and/or the L-shaped brackets 78. Again, by attaching two L-shaped brackets 78 to form the T-shaped member 76 and the fence attaching arrangement 42, both of which extend in a vertical direction, together with horizontally-extending L-shaped brackets 78, these grooves 82 are formed for rigidly holding the fencing material, e.g., expanded metal mesh material, in place.

As also illustrated in FIGS. 9 and 10, adjacently-positioned fence panels 32 may be attached together using the fence attaching arrangement 42. In particular, and in this embodiment, the fence arrangement 30 includes a groove arrangement 84 attached to, positioned at, or integral with a first fence panel 86, and this groove arrangement 84 includes multiple walls 88 defining a receiving groove 90. A second fence panel 92 is attached to or includes a tongue portion 94 attached to, positioned at, integral with, or extending from an edge thereof, and this tongue portion 94 is configured, sized, and shaped to be positioned between the walls 88 and in the receiving groove 90. Once these components are positioned together, i.e., the tongue portion 94 is inserted into receiving groove 90, various additional welds or other attaching methods may be used to secure the arrangement. Further, it should be noted that the receiving groove 90 may be defined to have extra space therein to permit for the expansion and contraction between the first fence panel 86 and the second fence panel 92. As the barrier fencing system 10 of the present invention is often used in environments with fluctuating temperatures, the orientation and relative positioning between the groove arrangement 84 and the tongue portion 94, i.e., providing this extra space or expansion area, allows for the expansion and contraction of the fence panels 32 under such conditions.

In another variation, the groove arrangement 84 is in the form of multiple plates 96 that are attached together, as well as attached to or integral with laterally-extending L-shaped brackets 78 at a specified position. Similarly, the tongue portion 94 may be attached to or integral with an adjacent L-shaped bracket 78. In either case, this groove arrangement 84 provides for effective attachment of a first fence panel 86 to a second fence panel 92. As also illustrated in FIGS. 9 and 10, the groove arrangement 84 may include a leg 98, such as a leg 98 extending from a plate 96 (or a previously-manufactured L-shaped bracket 78). This leg 98 is sized and shaped so as to contact or abut the extension member 20. In addition, the leg 98 may be attached or welded directly to a surface of the extension member 20, thus providing additional structural integrity to the barrier fencing arrangement 10. Still further, and in order to provide additional securing of the groove arrangement 84, one or more plug weld holes 100 may be provided on the plates 96 into which welding materials are heated and/or inserted. This assists in more firmly securing the plates 96 together to form the receiving groove 90, and further assists in clamping the tongue portion 94 within the receiving groove 90. Also illustrated in the embodiment of FIG. 9 is the migration port 48.

Figure 11:
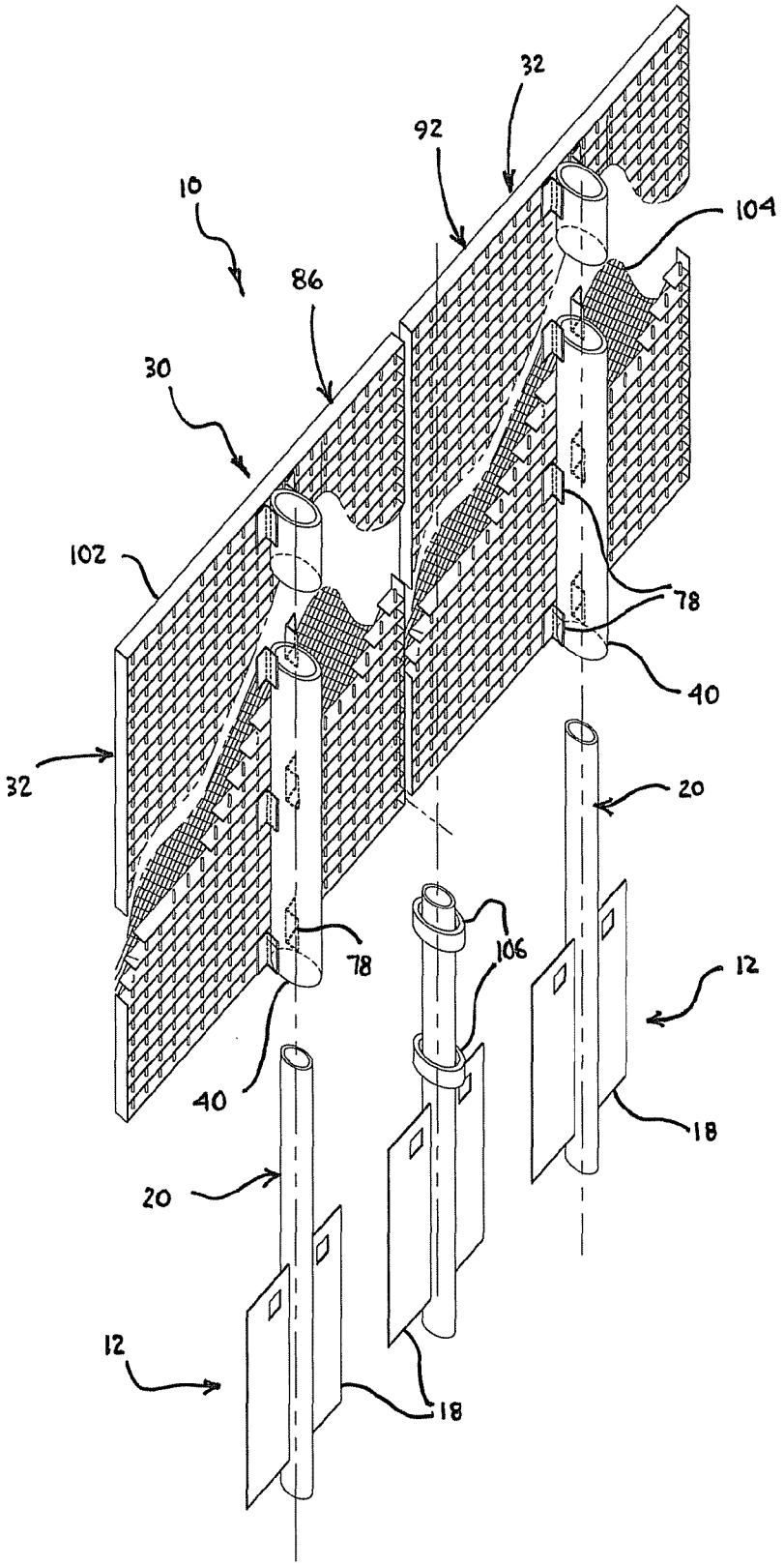
FIG. 11 is a perspective, exploded view of a further embodiment of a barrier fencing arrangement according to the principles of the present invention.
Figure 12:
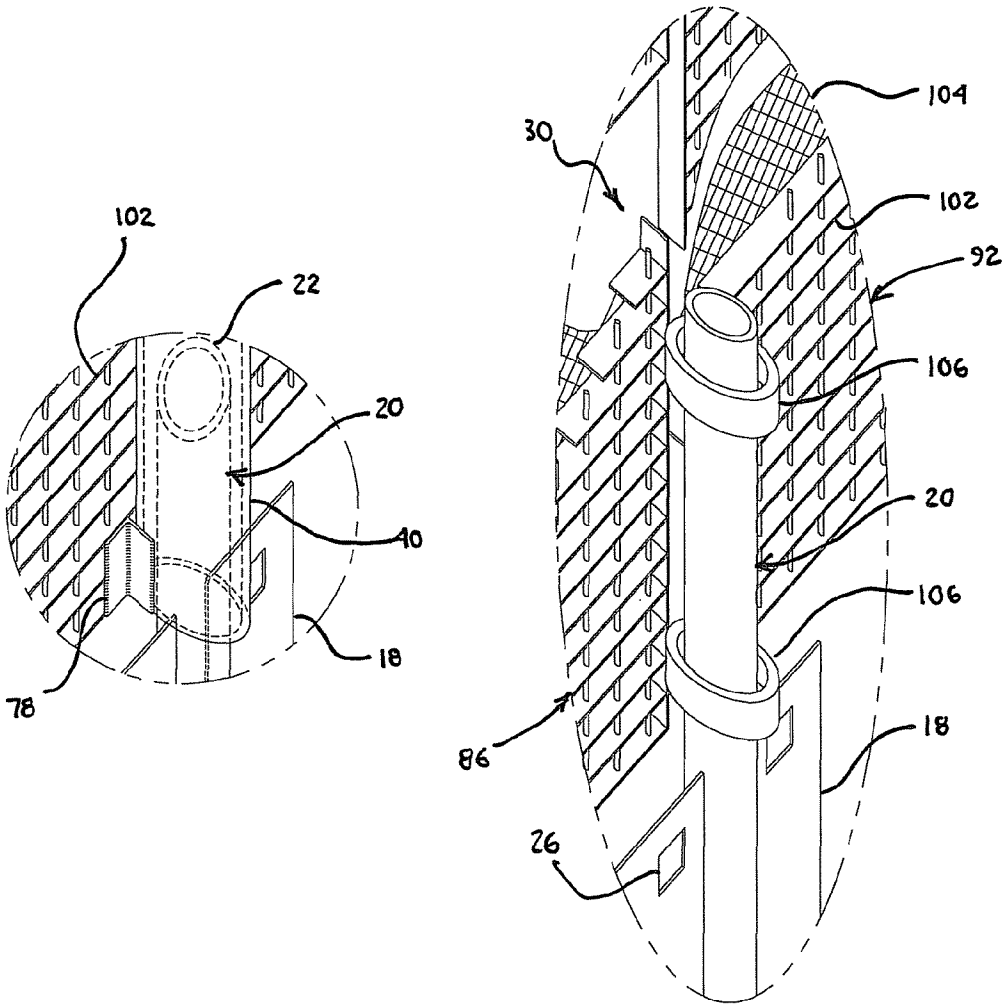
FIG. 12 is a perspective view of various portions of the embodiment of FIG. 11.
Figure 13:
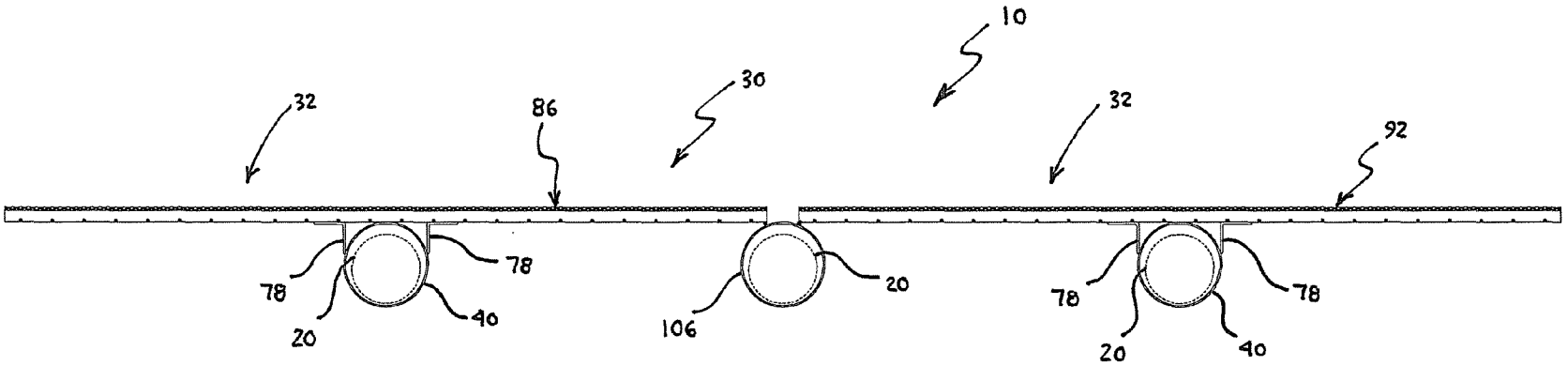
FIG. 13 is a plan view of the embodiment of FIG. 11.

Another preferred and non-limiting embodiment of the barrier fencing arrangement 10 of the present invention is illustrated in FIGS. 11-13. In this embodiment, the fence arrangement 30 includes a sleeve member 40 slideable or positionable over the extension member 20 in the manner discussed above. This sleeve member 40 is attached to the fence panel 32, which, in this embodiment, includes a grate panel 102 with a mesh panel 104 attached thereto. Accordingly, the fence panel 32 includes two different types of fencing material attached together to provide additional security along the barrier fencing arrangement 10. The sleeve member 40 is attached directly to a surface of the grate panel 102 via one or more L-shaped brackets 78. In particular, these L-shaped brackets 78 are welded between the grate panel 102 and a surface of the sleeve member 40.

In this embodiment, and as best illustrated in FIGS. 12 and 13, one or more sleeve rings 106 are attached to an edge or corner area of the first fence panel 86 and the second fence panel 92. It is envisioned that these sleeve rings 106 (which act in a similar manner as the sleeve member 40) are sized and shaped so as to be positionable over and around an extension member 20. For example, these sleeve rings 106 can be spaced along the joint or opposing edge area between the first fence panel 86 and the second fence panel 92, and attached or welded to a surface or edge of each panel 86, 92.

In assembly and as is similar to the assembly and installation process discussed above with other embodiments, a respective fence panel 86, 92 is attached over an extension member 20 by sliding the sleeve member 40 over the extension member 20. Next, the sleeve rings 106 are placed over an extension member 20 and attached to surfaces of each fence panel 86, 92. It should be noted that the attachment of the sleeve rings 106 may occur prior to installation (and slid over a respective extension member 20 in a similar manner as the sleeve member 40), or alternatively, may be attached after installation and positioning of two adjacent fence panels 86, 92. Still further, the sleeve members 40 may be directly attached to a surface of the grate panel 102 (or fence panel 32) through known welding techniques; however, the use of the L-shaped brackets 78 provides a more secure attachment when the sleeve members 40 are in tubular form.

Figure 14:
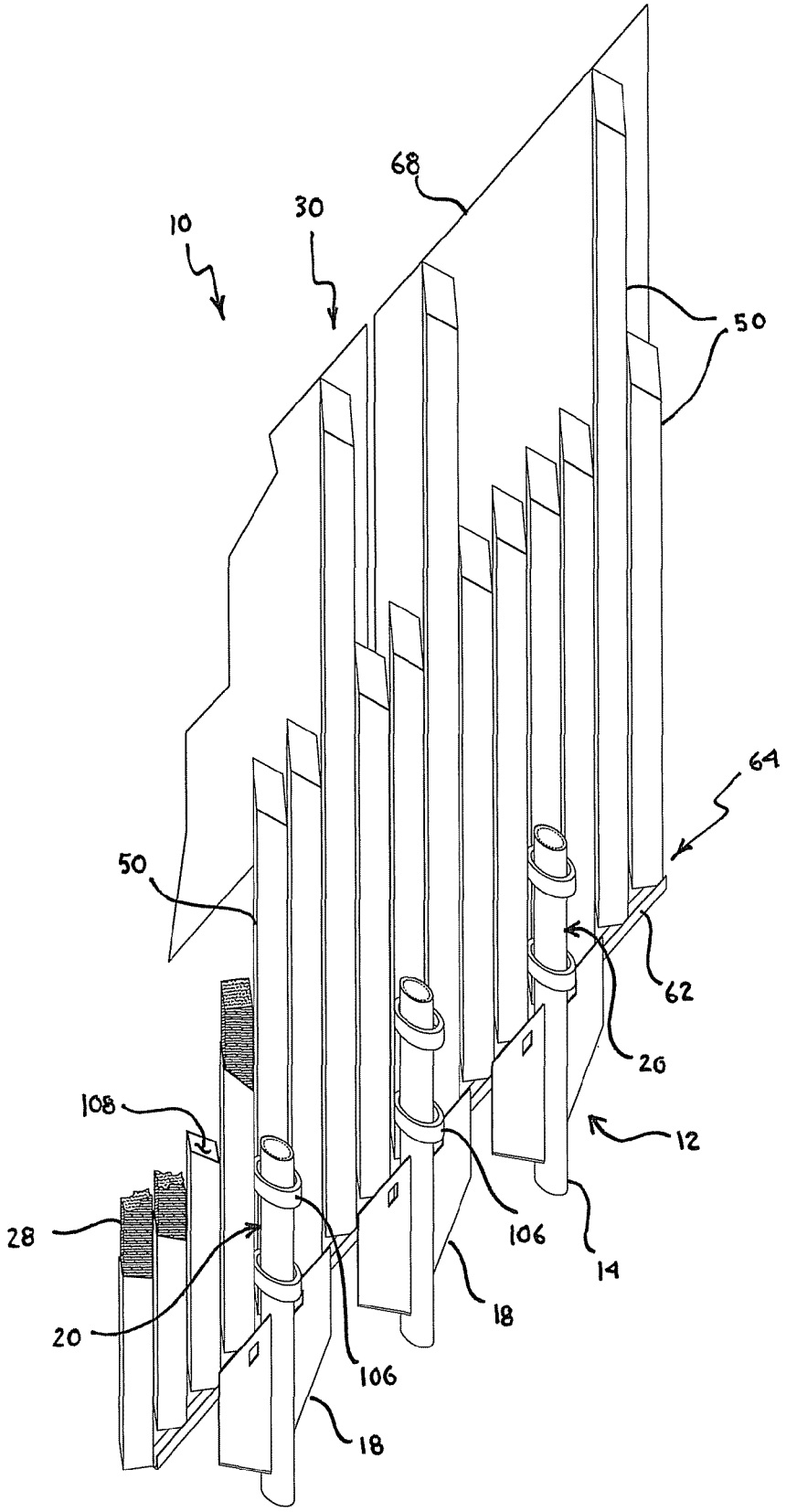
FIG. 14 is a perspective, exploded view of a still further embodiment of a barrier fencing arrangement according to the principles of the present invention.

Yet another preferred and non-limiting embodiment of the barrier fencing arrangement 10 of the present invention is illustrated in FIG. 14. This embodiment is similar to the embodiment illustrated in FIG. 8 and includes multiple posts 50 secured together by a frame bracket 62 attached to and extending along the bottom edge 64 of the posts 50. In addition, in this embodiment, the frame bracket 62 is attached to the fins 18, such as by welding or the like, which provide for greater coupling strength and resistance to overturning moments. However, in this embodiment, as opposed to the longitudinally-extending sleeve member 40 slid over a respective extension member 20, the barrier fencing arrangement 10 includes the sleeve rings 106 (as discussed above). These sleeve rings 106 are attached between and to the surfaces of one or more sets of adjacent posts 50, and are sized and shaped so as to be easily slid over the body 22 of extension member 20.

As discussed above, these sleeve rings 106 may be previously attached to two posts 50 prior to installation, or attached (e.g., welded) to the posts 50 after positioning, such as when the posts 50 have already been connected together via the frame bracket 62. As with the embodiment of FIG. 8, the embodiment of FIG. 14 also includes plates 68 attached at one side of the posts 50, which prevents manipulation or movement between the posts 50. Still further, in this embodiment, the posts 50 are manufactured in a substantially square shape, and are hollow, thus having an inner area 108. As discussed above, this inner area 108 may be filled with a material 28, such as concrete, metal rods, etc.

Figure 15:
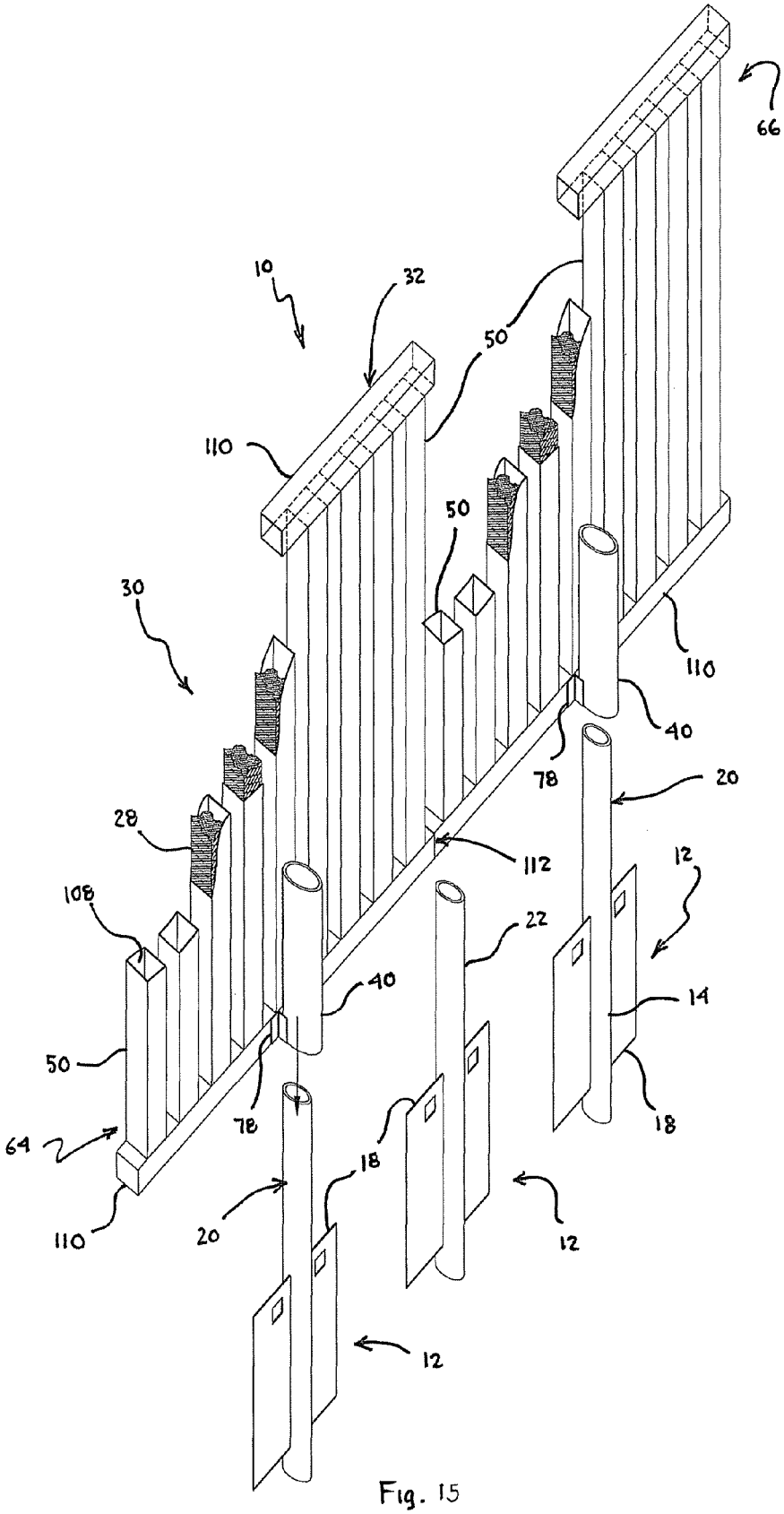
FIG. 15 is a perspective, exploded view of yet another embodiment of a barrier fencing arrangement according to the principles of the present invention.

A still further preferred and non-limiting embodiment, which is similar to the embodiments of FIGS. 8 and 14, is illustrated in FIG. 15. In this embodiment, sleeve members 40 are provided and attached to a post 50, either directly or via one or more L-shaped brackets 78. As discussed, these sleeve members 40 are slid over a respective extension member 20. This embodiment also includes square-shaped posts 50 that are filled with a strengthening material 28.

In the embodiment of FIG. 15, as opposed to using L-shaped brackets 78 as the frame bracket 62 (as in FIG. 14), a horizontally extending beam 110 (which is similar in size and shape to the posts 50) is utilized. In particular, a beam 110 is attached below and along the bottom edges 64 of multiple posts 50, as well as attached to the top edges 66 of these multiple posts 50. Accordingly, the fence arrangement 30 provides the attached groups of posts 50, which act as fence panels 32. These fence panels 32 are connected to the sleeve members 40 via one or more L-shaped brackets 78, and may be attached to a surface of a beam 110 and/or a surface of the post 50. In assembly, a sleeve member 40 is slid over a respective extension member 20. Similarly, the first fence panel 86 may be abutted with the second fence panel 92, and the abutting joint 112 may be welded to attach the first fence panel 86 to the second fence panel 92. Further, this joint 112 may be further secured by abutting it against a body 22 of an extension member 20, or even attached or welded thereto. Still further, the beam 110 may be attached or welded to the foundation member 12, such as along the fins 18 and/or body 14.

Figure 16:
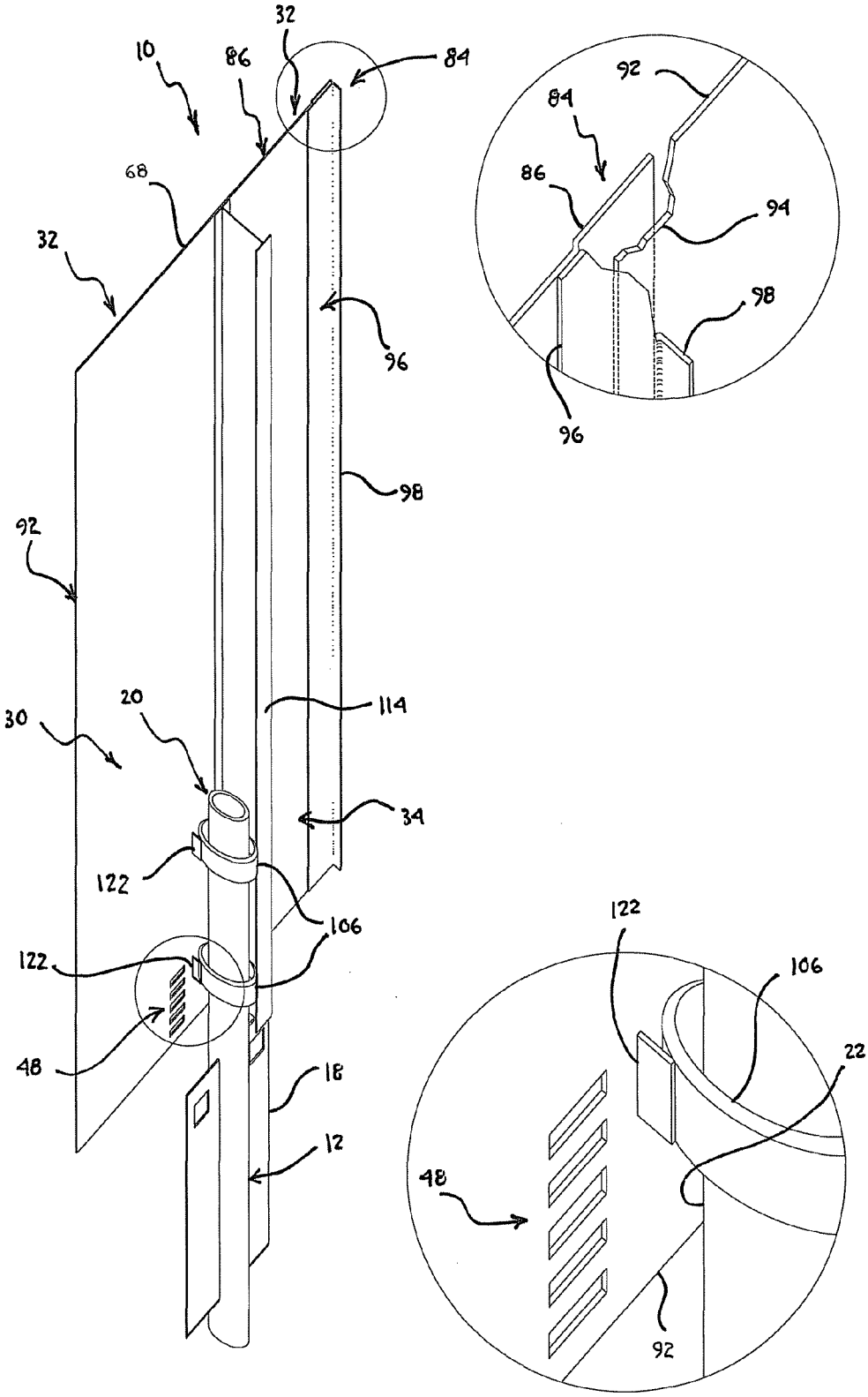
FIG. 16 is a perspective view of various portions of yet another embodiment of a barrier fencing arrangement according to the principles of the present invention.
Figure 17:
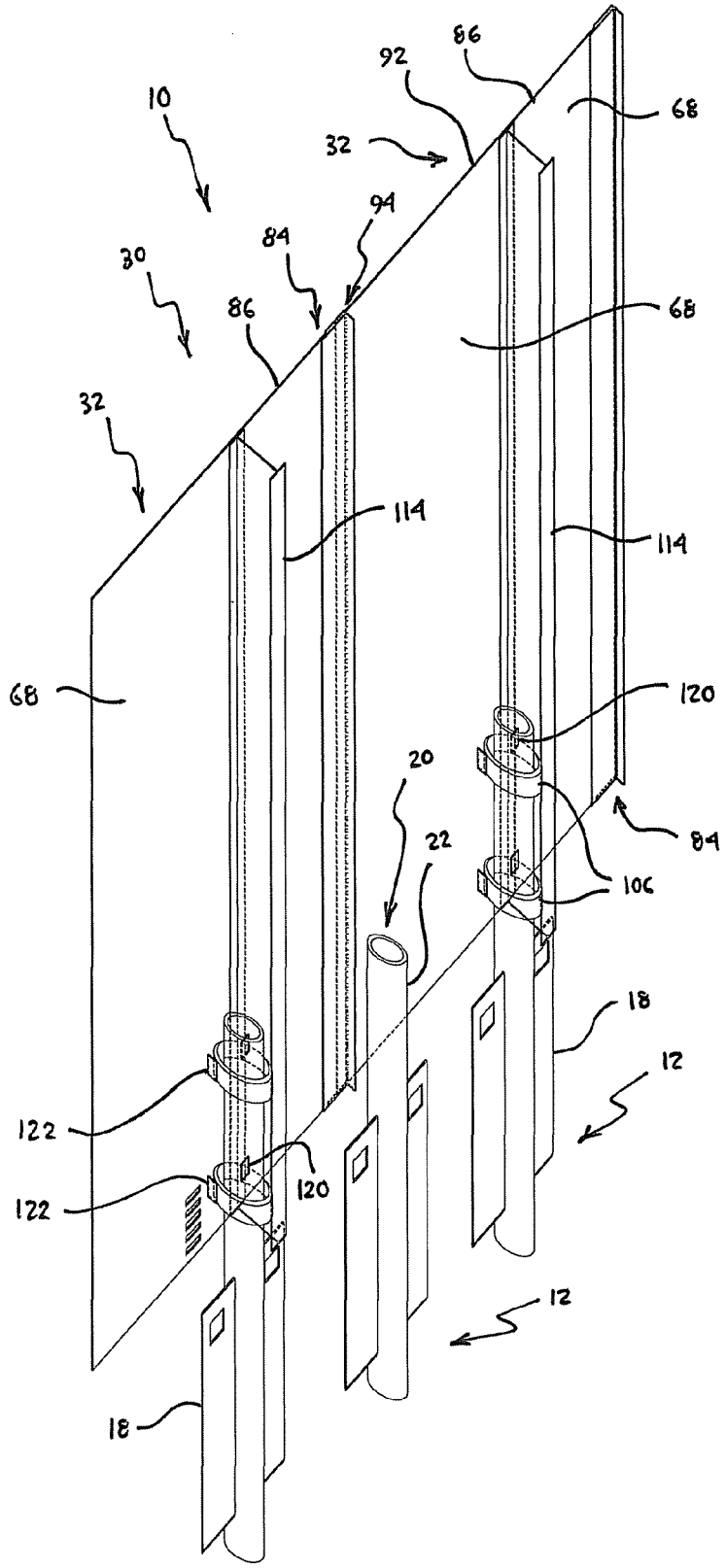
FIG. 17 is perspective view of the embodiment of FIG. 16.
Figure 18:
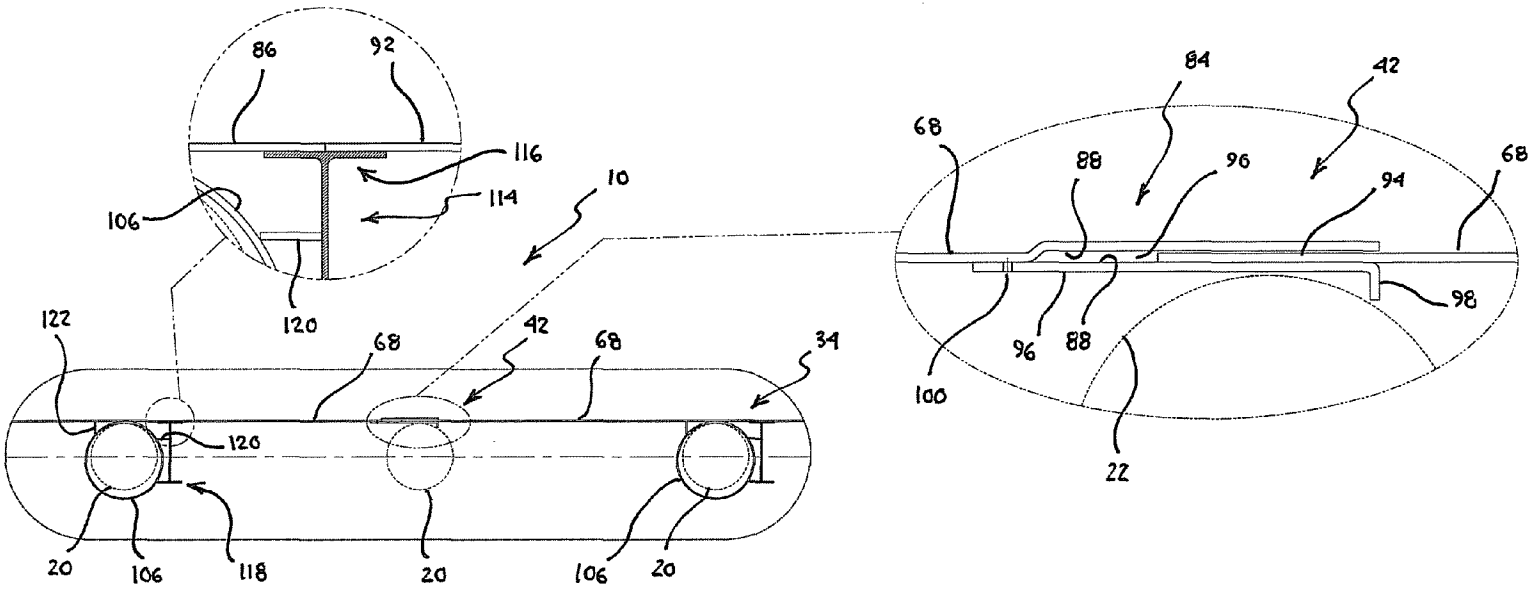
FIG. 18 is a plan view of various portions of the embodiment of FIG. 16.

Another embodiment of the barrier fencing arrangement 10 of the present invention is illustrated in FIGS. 16-18. In this embodiment, the fence arrangement 30 includes a fence panel 32 in the form of a plate 68, and the attachment assembly 34 includes sleeve rings 106, which are attached to a respective plate 68 as discussed hereinafter. Specifically, the attachment assembly 34 of this embodiment includes an I-beam 114 having a first end 116 and a second end 118. The first end 116 of the I-beam 114 is attached to a surface of the plate 68 (or possibly at a joint between two abutting plates 68), while a portion of the second end 118 of the I-beam 114 is attached to one or more of the sleeve rings 106. Of course, it is envisioned that the discussed sleeve member 40 may be used in place of these sleeve rings 106, if additional strength is required.

In order to provide additional attachment characteristics and strength, the attachment assembly 34 may also include a first leg 120 attached between a surface of the I-beam 114 and one or more of the sleeve rings 106, as well as a second leg 122 attached between a surface of the plate 68 and one or more of the sleeve rings 106. As discussed, the attachment between the individual components may occur through a variety of known methods, and when attaching metal components, welding is the preferred technique.

In order to attach the first fence panel 86 to the second fence panel 92, and as best illustrated in FIGS. 17 and 18, the fence attaching arrangement 42 may be in the form of the groove arrangement 84 and tongue portion 94. In this embodiment of the groove arrangement 84, the plate 68 that acts as the first fence panel 86 is bent or shaped, with a separate smaller plate 96 attached thereto, thus forming the receiving groove 90 as discussed above. Further, one or more plug weld holes 100 may be used to provide additional attachment between the plate 96 and the plate 68. As discussed, the groove arrangement 84 and tongue portion 94 may also be configured and oriented to provide for expansion and contraction of the fence panels 86, 92.

In this embodiment, the tongue portion 94 (which is inserted into or positioned within the receiving groove 90) is formed by the edge portion of the second fence panel 92, as this second fence panel 92 is already in the form of a plate 68. Thereafter, the groove arrangement 84 and tongue portion 94 can be attached or welded together. Still further, and as discussed above in connection with the other embodiments of the groove arrangement 84, a leg 98 may be provided and attached or welded directly against an extension member 20. In this manner, the barrier fencing arrangement 10 is formed from a series of attached plates 68, which are directly or indirectly attached to respective extension members 20.

As best illustrated in FIG. 18, the first end 116 of the I-beam 114 may be attached to, and connect together, the first fence panel 86 and the second fence panel 92 at one of the joints, while the fence attaching arrangement 42 is used to attach subsequent fence panels 32. Accordingly and as is apparent in this and other embodiments, multiple fence panels 32 are attached together to provide a fence line of appropriate length for the specified project. Alternatively and as discussed above, the first end 116 of the I-beam 114 may be connected anywhere along the surface of the fence panel 86, 92, or plate 68. As also illustrated in FIG. 16 and in this embodiment, multiple ports 48 or access orifices are provided, which can be used for migration of small animals and/or movement of rainwater and the like.

Figure 19:
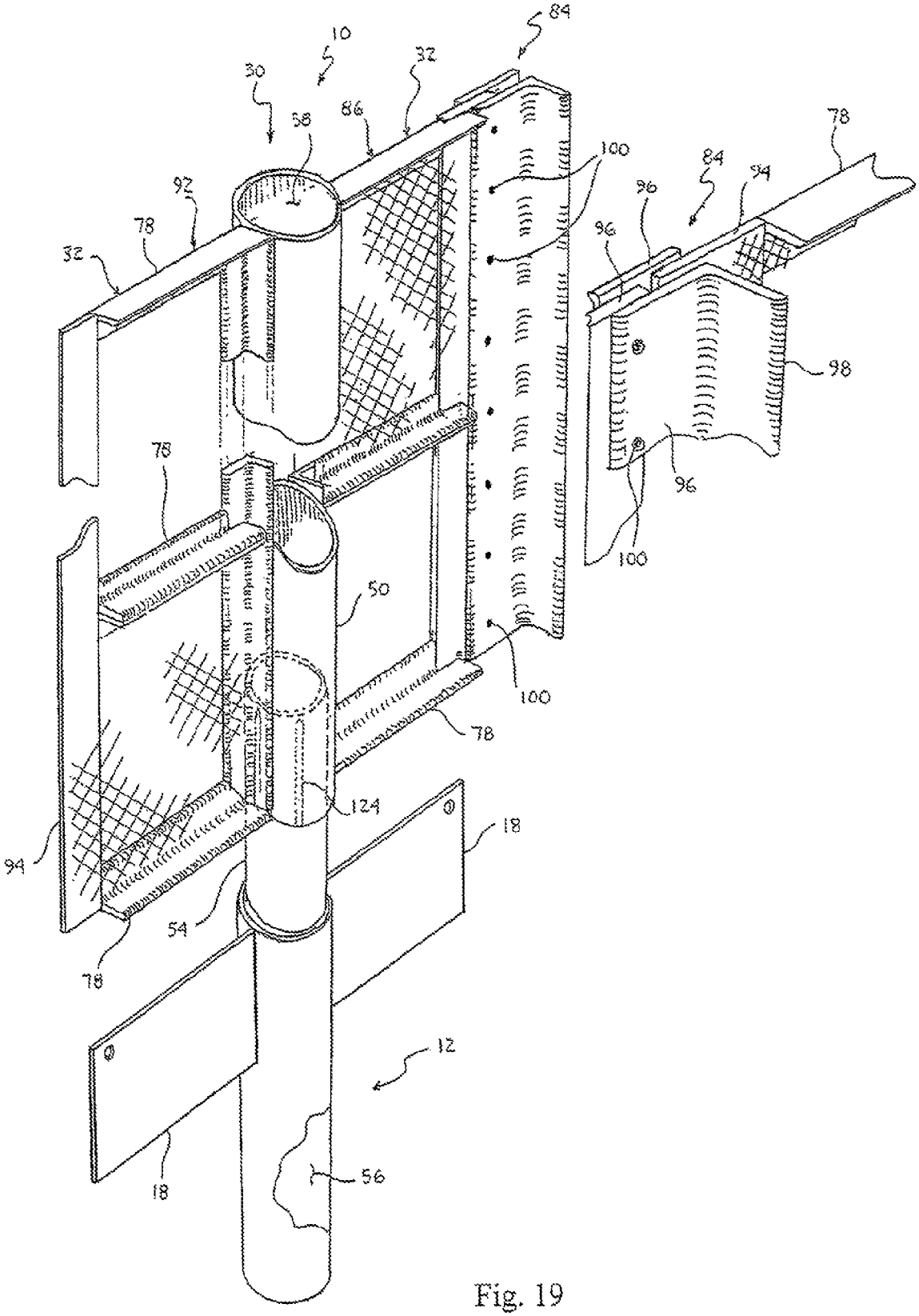
FIG. 19 is a perspective, exploded view of various portions of a further embodiment of a barrier fencing arrangement according to the principles of the present invention.

A still further preferred and non-limiting embodiment of the barrier fencing arrangement 10 of the present invention is illustrated in FIG. 19. In this embodiment, the fence arrangement 30 includes fence panels 32 that are made up of various and specifically oriented L-shaped brackets 78 that form the groove 82 into which a mesh panel 104 or other similar fencing material can be situated and attached. In addition and in this embodiment, the L-shaped brackets 78 are directly attached to a post 50, such as by welding or similar attachment method. In this manner and by using these L-shaped brackets 78, both the first fence panel 86 and the second fence panel 92 are attached to the outer surface of the post 50.

The fence attaching arrangement 42 of this embodiment is similar to the fence attaching arrangement 42 illustrated in the embodiment of FIGS. 9 and 10. Specifically, the groove arrangement 84 is situated on an edge of the first fence panel 86, while the tongue portion 94 is arranged or positioned on an edge of the second fence panel 92. The attachment, assembly, and use of the groove arrangement 84 and tongue portion 94 are as discussed above. Similarly, multiple plug weld holes 100 are positioned along at least one of the plates 96 in order to provide additional engagement and coupling of the plates 96 creating the walls 88 and receiving groove 90, and/or the tongue portion 94.

Figure 6:
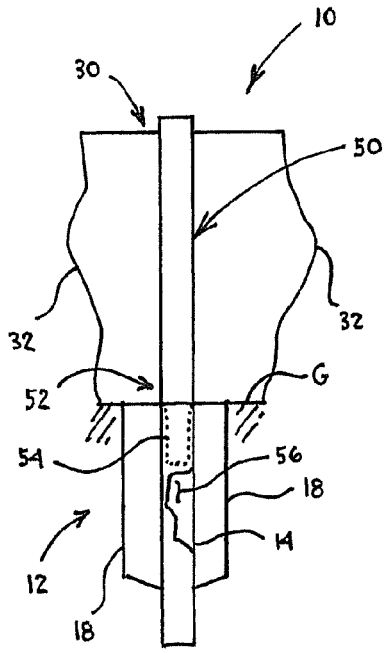
FIG. 6 is a front view of a further embodiment of a barrier fencing arrangement according to the principles of the present invention.

In order to attach the fence arrangement 30 to the foundation member 12, and as similar to the embodiment of FIG. 6, the post 50 includes a coupling extension 54. However, in this embodiment, the coupling extension 54 is a separate piece that is attached or welded within the inner area 58 of the post 50 prior to installation. Further, in order to facilitate this attachment and installation, the outer surface of the coupling extension 54 may include multiple spacers 124, as seen in FIG. 19.

In installation and assembly, a section of the fence arrangement 30 is positioned such that the coupling extension 54 enters into and extends within the inner area 56 of the body 14 of the foundation member 12. Once the coupling extension 54 has been fully inserted and the edge of the post 50 abuts the edge of the body 14 of the foundation member 12, this joint may be further attached or welded to ensure additional structural integrity.

Accordingly, the present invention provides a barrier fencing arrangement 10 represented by various preferred and non-limiting embodiments usable in a variety of applications and situations. For example, these different embodiments of the present invention can be used alone or in combination to provide appropriate fence barrier systems in border security applications, and in the form of a primary fence, a secondary fence, a permanent vehicle barrier, etc. Using combinations and arrangements of the barrier fencing arrangement 10 provides a modular approach, allowing the components to be easily assembled at an onsite location into a unified system. While any number of materials of manufacturing may be used, in one preferred and non-limiting embodiment, the different components and pieces of the barrier fencing arrangement 10 are made from stainless steel, and these components are welded together to complete the barrier fencing arrangement 10. Once installed, the assembled structure, which may vary in height and width (depending upon the design criteria of the project) provides a unique and effective approach to security and border control. In addition, some or all of the embodiments of the barrier fencing arrangement 10 of the present invention meet and/or exceed the performance criteria established by the United States Customs and Border Patrol.

Further, the barrier fencing arrangement 10 may be fully assembled prior to transit, which eliminates the need and time expenditure of assembling the parts at the site. For example, when used in connection with a preinstalled foundation member 12, a fencing arrangement 30, and, in particular, a section of this fencing arrangement 30 may be installed within minutes, which evidences the benefits of such a modular approach. In this manner, the barrier fencing arrangement 10 of the present invention eliminates the need for multiple tasks involving additional time, labor, and material costs, thus creating a complete and cost effective system compared to prior art systems and arrangements. In addition, the barrier fencing arrangement 10 of the present invention allows for the combination and custom design providing specifically-tailored fencing systems, which overcome various individual problems associated with pre-existing systems.

In one example, the foundation member 12, extension member 20, and fence arrangement 30 may be at least partially assembled offsite and delivered to the installation site in this partially assembled form. For example, one standard size of a fence panel 32 is approximately 8 foot wide by 12 foot high (though height and width can vary depending upon the project), and delivery of this section may be made by a tractor trailer in which 36 to 48 completed sections can be delivered on one trailer. Once these sections arrive at the site, a crane may be used to lift the structures from the trailer and set in place, as described in detail above.

As also discussed and depending upon the project and embodiments used, as well as the location, terrain and whether or not the foundation member 12 is previously installed, the section of the fencing arrangement 30 (with or without the foundation member 12 and extension member 20) can be joined using the above-described attachment assemblies 34 and fence attaching arrangements 42. Using these connection techniques, the sections can be joined, e.g., on an 8-foot basis, and extend the necessary distance specified for the individual project, thus creating a long fence line.

The barrier fencing arrangement 10 of the present invention represents a unique and useful structure and installation process that are significantly different and more beneficial than prior art technology and existing fence systems. As discussed above, the embodiments of the barrier fencing arrangement 10 can be combined to create a better, more efficient and cost effective fencing system. Many steps that were previously required have been eliminated, and this barrier fencing arrangement 10 is capable of meeting and/or exceeding specified performance criteria. In one preferred and non-limiting embodiment, solid steel components are used, whereas previous systems often use carbon steel that is pieced and welded together, or a chain link-type fence system requiring numerous parts, which are time consuming to erect. In addition, these previous systems used concrete foundations, whereas the present invention utilizes the unique foundation member 12 with the fins 18.

In this manner, the present invention provides a barrier fencing arrangement 10 that demonstrates one or more of the following benefits and advantages when compared to existing and prior art fence systems: (1) cost effectiveness; (2) meeting all established performance criteria; (3) minimal, if any, environmental disturbance; (4) rate of production in minutes, compared to days; (5) limited amount of installation steps; (6) workforce required for installation is reduced by 50%; (7) ease of installation, preassembly, and no additional components required; (8) little or no maintenance costs or time involved; (9) effectively prevents unauthorized entry significantly sooner than current systems; (10) thermal expansion and contraction is taken into account in the design and, therefore, eliminates maintenance problems that exist with current technology; (11) no concrete foundations required for support of the structure; and (12) providing the ability to see through the fencing in some embodiments. In addition to all these benefits, one significant benefit afforded by the barrier fencing arrangement 10 of the present invention is the ability to immediately secure the border areas in a matter of minutes and days, as compared to months and years using the current systems. The overall effect this will have on the total cost and time savings involved with the reduction of unauthorized entry along the border is immense.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements. For example, it is to be understood that the present invention contemplates that, to the extent possible, one or more features of any embodiment can be combined with one or more features of any other embodiment.

The invention claimed is:

1. A barrier fencing arrangement for controlling passage both above and below a ground surface, comprising:

a plurality of foundation members positioned at least partially below the ground surface, each of the foundation members having a body with a top portion and at least one fin extending from the body, the at least one fin being substantially coplanar with at least one fin of each adjacent said foundation member, the fins extending a similar distance away from their respective foundation members;

a plurality of extension members, each of the extension members attached to or integral with the body of a respective said foundation member and extending from the top portion of the foundation member at least partially above the ground surface;

a fence arrangement, comprising a plurality of adjacently positioned fence panels disposed on the plurality of extension members, wherein the fence panels extend between adjacent extension members to block passage above the ground surface, wherein the coplanar fins of each pair of adjacent foundation members substantially span the distance between the adjacent foundation members to block passage below the ground surface beneath each fence panel; and at least one access portion formed in at least one said fence panel, the access portion having a width and configured to selectively permit access through the fence arrangement;

wherein one of the fins extending from a foundation member associated with an extension member having a fence panel with an access portion disposed therein extends, toward a coplanar fin of an adjacent said foundation member, underneath and at least a distance equal to the width of the access portion.

2. The barrier fencing arrangement of claim 1, wherein each foundation member further comprises a bearing plate attached to the top portion thereof, and a respective extension member attached thereto, wherein the bearing plate is configured to contact the ground surface.

3. The barrier fencing arrangement of claim 1, wherein at least one of the body of each of the foundation members and the extension members is at least partially filled with a material.

4. The barrier fencing arrangement of claim 1, wherein the fence arrangement comprises:

at least one sleeve member positionable at least partially over a respective extension member;

a bracket assembly attached to and extending from a surface of the sleeve member; and a fence panel attached to at least a portion of the bracket assembly.

5. The barrier fencing arrangement of claim 1, wherein at least two adjacently positioned fence panels are directly or indirectly attached to at least one of a respective foundation member and a respective extension member.

6. The barrier fencing arrangement of claim 1, wherein the fence panels are formed at least partially from at least one of the following: a mesh material, a fencing material, an expanded metal material, metal, a plate material, a plurality of posts, a grated surface, a framed section or any combination thereof.

7. The barrier fencing arrangement of claim 1, wherein the at least one access portion is at least one of the following: a doorway, a port, a permanent opening, an access panel, a removable panel, a swinging panel, a hinged panel, a movable panel or any combination thereof.

8. The barrier fencing arrangement of claim 1, further comprising a post arrangement attached to a least one of a respective foundation member and a respective extension member.

9. The barrier fencing arrangement of claim 8, wherein the post arrangement comprises a plurality of posts directly or indirectly attached to at least a portion of the foundation member.

10. The barrier fencing arrangement of claim 8, wherein the post arrangement comprises at least one sleeve member attached to at least one post and positionable at least partially over the extension member.

11. The barrier fencing arrangement of claim 8, wherein the post arrangement comprises:

a plurality of posts; and at least one sleeve member slidable at least partially over a respective extension member;

wherein at least one of the plurality of posts is directly or indirectly attached to at least one sleeve member.

12. The barrier fencing arrangement of claim 1, wherein the at least one fin extends radially from the body of a respective foundation member and includes at least one beveled edge on a bottom portion thereof.

13. A barrier fencing arrangement for blocking both above ground and underground passage, comprising:

a plurality of foundation members positioned at least partially below a ground surface, each of the foundation members having a body with a top portion and at least one fin extending from the body; and a fence arrangement, comprising a plurality of adjacently positioned fence panels disposed on the plurality of foundation members, wherein the fence panels extend between adjacent foundation members to block passage above the ground surface, wherein at least one doorway configured to permit access through the fence arrangement is defined within at least one said fence panel, wherein the plurality of foundation members is arranged such that at least one fin of each foundation member is coplanar with at least one fin of each adjacent said foundation member, wherein each fin is sized to extend at least a distance greater than the width of the at least one doorway and extends to substantially meet a coplanar said at least one fin of an adjacent foundation member such that the coplanar fins of adjacent foundation members substantially span the distance between the adjacent foundation members to block passage below the ground surface beneath each fence panel, and wherein one of the fins extending from a foundation member associated with a fence panel with a doorway disposed therein extends, toward a coplanar fin of an adjacent said foundation member, underneath the doorway.

14. The barrier fencing arrangement of claim 13, wherein the fence arrangement comprises:

at least one post having an inner area; and a fence panel directly or indirectly attached to the at least one post;

wherein the barrier fencing arrangement further comprises at least one coupling extension extending from the top portion of each of the foundation members and positionable at least partially within the inner area of the post.

* * * * *